United States Patent [19]

Sato et al.

[11] 4,000,011

[45] Dec. 28, 1976

[54] METHOD OF SURFACE HARDENING

[75] Inventors: Nobuaki Sato; Katsuro Yamasaki, both of Hiroshima, Japan

[73] Assignees: Toyo Kogyo Co., Ltd.; Yoshiwa Kogyo Kabushiki Kaisha, both of Japan

[22] Filed: Sept. 7, 1972

[21] Appl. No.: 287,025

[30] Foreign Application Priority Data

Sept. 9, 1971 Japan ..... 46-70156

[52] U.S. Cl. ..... 148/4; 75/123 CB; 75/124; 148/3; 148/13; 148/35; 148/39; 219/121 EB; 418/178

[51] Int. Cl.[2] ..... C21D 1/06; C21D 5/00; H05B 7/00

[58] Field of Search ..... 75/124, 123 CB, 130; 148/3, 4, 13, 35, 138, 141, 39; 219/121 EB; 29/527.6, 557; 164/122, 127

[56] References Cited

UNITED STATES PATENTS

| | | | |
|---|---|---|---|
| 2,184,518 | 12/1939 | Eash et al. | 148/35 X |
| 2,968,723 | 1/1961 | Steigerwald | 148/13 R |
| 3,033,676 | 5/1962 | Cox | 75/123 CB |
| 3,658,451 | 4/1972 | Gomada | 418/178 |

*Primary Examiner*—C. Lovell

*Attorney, Agent, or Firm*—Wenderoth, Lind & Ponack

[57] ABSTRACT

A method of surface hardening for forming a hardened layer of cemented carbide, including cementite, on a local surface area of cast iron by rapidly melting the local surface by means of a rapid melting process such as the electron bombardment melting process to form a molten pool thereon, then rapidly cooling the molten pool by the chilling effect of the non-molten portion of cast iron and finally finishing the cast iron having the hardened layer thus formed to a desired shape. To this end, the cast iron used contains therein one or a mixture of deoxidizing agents such as aluminum, magnesium and calcium.

4 Claims, 3 Drawing Figures

METHOD OF SURFACE HARDENING

Figure 1:
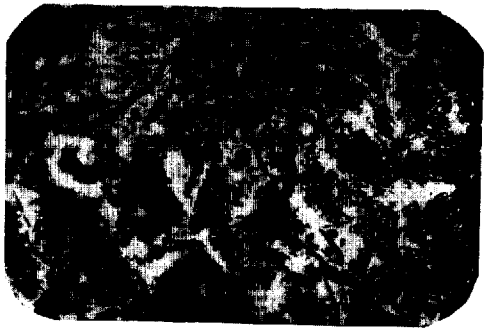

The present invention relates to a method of surface hardening and, more particularly, to a method of chilling a surface of a body of cast iron to form a hardened layer of cemented carbide, including cementite, which is generally referred to as a chilled structure.

The present invention also pertains to the provision of a surface-hardened cast iron having formed at least one surface a hardened layer of cemented carbide, i.e., the chilled structure, down to a depth of several millimeters in accordance with the method herein disclosed.

It is generally well known that, if a solid of cast iron has formed on its surface a chilled structure, a high resistance to abrasion can be imparted to such surface area of the cast iron solid.

According to the conventional method of forming the chilled structure on the surface of a cast iron solid, a chill is placed in a mold for rapidly cooling a portion of molten iron poured into the mold, thereby imparting to that portion of molten iron a chilled structure after it has been completely solidified. However, this conventional method lacks sufficient adaptability in manufacturing very small and thin mechanical parts, which may otherwise result in the whole body of molten iron being quickly cooled to form the parts having a chilled structure throughout.

U.S. Pat. No. 3,658,451 patented on Apr. 25, 1972, assigned to the assignees of the present application, discloses an improvement in the surface-hardening method of similar character which has proved to be successful and satisfactory in substantially eliminating the disadvantages inherent in the conventional surface-hardening method.

According to the above U.S. Patent, the surface-hardening method has been disclosed as substantially comprising preparing a solid of cast iron having a particular shape, rapidly melting one surface area of said cast iron solid by the application of an electron beam or by other suitable means such as arc, laser light and plasma, which can achieve quick melting in a short time, thereby to form a molten pool of several millimeters depth below the surface of said cast iron solid, and quickly cooling or chilling the molten pool by the effect of temperature differential between the molten pool and the other nonmolten portion of said cast iron solid thereby to impart the chilled structure to the surface area of the solid of cast iron. In this method, no chill such as heretofore employed in execution of the conventional method is utilized.

However, during execution of the surface-hardening method as disclosed in the above U.S. Patent, it had been found that, during formation of the molten pool on the surface area of a cast iron solid by the process of electron bombardment melting (electron beam bombardment melting), oxygen contained in the cast iron in combination with metallic elements, is liberated which in turn reacts with graphite, contained in the cast iron, to produce carbon dioxide which finally leads to formation of blowholes and/or pinholes in the resultant chilled structure. The presence of such blowholes and/or pinholes in the resultant chilled structure naturally reduces not only the strength of the chilled structure, but also the affinity to a coacting element to be used in sliding engagement therewith. This disadvantage is found to be particularly considerable where the cast iron solid is made from any one of the non-spherulitic graphite cast irons, that is, any cast iron such as acicular cast iron and gray cast iron, other than spherulitic graphite cast iron or ductile cast iron which may be generally referred to as nodular graphite cast iron.

The present invention has been developed with a view towards eliminating the above-mentioned disadvantage inherent in the above U.S. Patent, which is satisfactorily achieved by adding one or more deoxidizing agents each having a sufficiently high melting point in molten metal during the preparation of cast iron to be subjected to the surface-hardening method of the present invention. The concept of the present invention is based on the finding, after research and a series of experiments that, if the melting point of an oxide formed upon solidification of molten iron during the preparation of flaky graphite cast iron is raised to a higher value than the temperature of the molten pool on the surface area of a solid body, made from the flaky graphite cast iron, which is subsequently formed by the rapid melting process such as electron bombardment melting to impart the chilled structure to the surface area thereof formation of the blowholes and/or pinholes by can be substantially avoided for the reasons hereinbefore described. From the foregoing, it is clear that the oxide formed upon solidification of molten iron during the preparation of flaky graphite cast iron must be in the form of MgO, $Al_2O_3$ or CaO which has a sufficiently high melting point and a strong bondability with respect to oxygen.

This can be achieved by adding, during the preparation of cast iron, one or mixture of deoxidizing agents such as Mg, Al and Ca in molten metal thereby to permit the additive to bond to oxygen to form an oxide in the composition of the resultant cast iron in the form of MgO, $Al_2O_2$ or CaO. It is to be noted that the melting points of such elements as MgO, $Al_2O$ and CaO are respectively 2,800°, 2,000° and 2,570° C., which are higher than the melting point of the deoxidizer containing cast iron by 200° C. Accordingly, when the deoxidizer containing cast iron is re-melted at one surface thereof by the rapid melting process such as electron bombardment process, no reaction take place between oxygen and graphite and, therefore, a solid body made from this cast iron does not contain blowholes and/or pinholes in its subsequently formed chilled structure.

The amount of any one of the deoxidizing agents employed will be hereinafter described.

1. Amount of Mg added:

It must be within the range of 0.002 to 0.03 wt% (percent by weight). If this amount is smaller than 0.002 wt%, the possibility of formation of a defective chilled structure will increase over 25% whereas, if this amount is more than 0.03 wt%, spatter will occur during the formation of the molten pool on one surface of the solid body made from the cast iron by the application of electron beam and, hence, the workability is not sufficient without improving the resistance to abrasion.

2. Amount of Al:

It must be within the range of 0.05 to 4.0 wt%. If this amount is smaller than 0.05 wt%, the possibility of formation of a defective chilled structure will increase over 25% whereas, if this amount is more than 4.0 wt%, the resultant chilled structure will contain a large amount of ferrite with consequent reduction of the resistance to abrasion.

3. Amount of Ca:

It must be within the range of 0.1 to 1.0 wt%. If this amount is smaller than 0.1 wt%, the possibility of formation of a defective chilled structure will increase over 25% whereas, if this amount is more than 1.0 wt%, the resistance to abrasion of the resultant chilled structure will be reduced.

The chilling method to be applied to the cast iron prepared by the addition of any one of the above mentioned deoxidizing agents may be substantially the same as disclosed in the aforesaid U.S. Patent and, therefore, description of the chilling method is herein omitted for the sake of brevity. In any event, an essential feature of the present invention resides in a combination of the chilling method with the use of the cast iron, particularly, acicular cast iron, prepared by the addition of the deoxidizing agent in the manner as hereinbefore described.

The present invention will be hereinafter fully described by way of non-limiting examples as set forth below.

EXAMPLE I

A solid body of acicular cast iron containing the following substances was first prepared.

| Substances | Amount (wt %) |
|---|---|
| C | 3.67 |
| Si | 2.34 |
| Mn | 0.40 |
| Cr | 0.50 |
| Cu | 0.99 |
| Mo | 1.46 |
| Ni | 1.02 |
| P | 0.20 |
| V | 0.20 |
| Mg | 0.005 |
| Fe | 89.215 |

A local surface area of this solid body was melted by the application of electron beams to form a molten pool which is in turn rapidly cooled by the effect of temperature differential between the molten pool and the other non-molten portion of said solid body to impart the chilled structure to the local surface of said solid body upon solidification of said molten pool. (This effect will be hereinafter referred to as the chilling effect.)

The result is illustrated in FIG. 1 which shows a photomicrograph of the resultant chilled structure taken at the magnified rate of 400 . In this photomicrograph, white and blackish portions represent a carbide and graphite, respectively, while the remaining portion represents a base of bainite. It is clear from the photomicrograph that no blowhole or pinholes is observable. However, when 100 pieces of solid bodies made of the acicular cast iron were subjected to the chilling method in the manner as hereinabove described, three of them were found to contain blowholes and/or pinholes.

EXAMPLE II

A solid body of acicular cast iron containing the following substances was first prepared.

| Substances | Amount (wt %) |
|---|---|
| C | 3.69 |
| Si | 2.25 |
| Mn | 0.40 |
| Cr | 0.51 |
| Cu | 0.93 |

-continued

| Substances | Amount (wt %) |
|---|---|
| Mo | 1.45 |
| Ni | 0.93 |
| P | 0.20 |
| V | 0.20 |
| Al | 0.05 |
| Fe | 89.39 |

Figure 2:
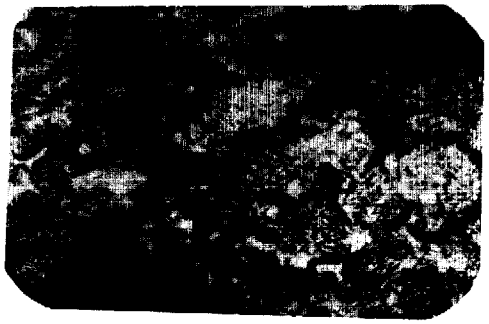

A local surface area of this solid body was melted by the application of electron beams to form a molten pool which is in turn rapidly cooled by the chilling effect to impart the chilled structure to the local surface of said solid body upon solidification of said molten pool. The result is illustrated in FIG. 2 which shows a photomicrograph of the resultant chilled structure taken at the magnified rate of 400. In this photomicrograph, white and blackish portions represent a carbide and graphite respectively, while the remaining portion represents a base of bainite. It is clear from the photomicrograph that no blowhole or pinhole is observable. However, when 100 pieces of solid bodies made of the acicular cast iron were subjected to the chilling method in the manner as hereinbefore described, a quarter of them were found to contain blowholes and/or pinholes.

EXAMPLE III

A solid body of acicular cast iron containing the following substances was first prepared.

| Substances | Amount (wt %) |
|---|---|
| C | 3.73 |
| Si | 2.23 |
| Mn | 0.41 |
| Cr | 0.52 |
| Cu | 1.02 |
| Mo | 1.50 |
| Ni | 1.00 |
| P | 0.20 |
| V | 0.21 |
| Ca | 0.20 |
| Fe | 88.90 |

Figure 3:
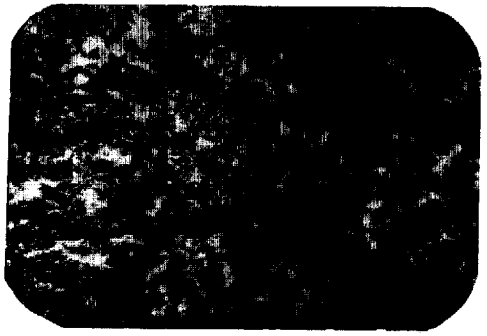

A local surface area of this solid body was melted by the application of electron beams to form a molten pool which is in turn rapidly cooled by the chilling effect to impart the chilled structure to the local surface of said solid body upon solidification of said molten pool. The result is illustrated in FIG. 3 which shows a photomicrograph of the resultant chilled structure taken at the magnified rate of 400. In this photomicrograph, white and blackish portions represent a carbide and graphite, respectively, while the remaining portion represents a base of bainite. It is clear from the photomicrograph that no blowhole or pinhole is observable. However, when 100 pieces of solid bodies made of the acicular cast iron were subjected to the chilling method in the manner as hereinbefore described, five of them were found to contain blowholes and/or pinholes.

In practice, the acicular cast iron prepared in the Example I was used as material for apex seals fixed at the respective apexes of a three-lobed rotary piston of a rotary piston engine. In this case, the surface of the acicular cast iron which is integrally formed with the chilled structure is used as a sliding surface of each of the apex seals which slidably engages with the inner surface of the casing of the rotary piston engine as the rotary piston undergoes planetary motion. The resistance to abrasion of each of the apex seals thus manufactured was found to be substantially the same as that made from acicular cast iron prepared without the addition of Mg, but the number of blowholes and/or pinholes appearing in the apex seal made from the acicular cast iron of the Example I was found to be smaller than that made from the acicular cast iron prepared without the addition of Mg so that the strength of the apex seal made from the acicular cast iron of the Example I could be improved. In addition the apex seal made from the acicular cast iron of the Example I was not found to cause a chatter mark on the inner surface of the casing of the rotary piston engine, which leads, as a whole, to an improvement in the life of the rotary piston engine.

Although the addition of any one of the deoxidizing agents in accordance with the present invention has been described as applied to acicular cast iron, it is well understood by those skilled in the art that it may be applied to any cast iron other than the acicular cast iron without substantial reduction of the advantages obtainable by the present invention. In addition, the addition of a mixture of two or more of Mg, Al and Ca is possible. In this case, the mixture of the deoxidizing agents must be added in amount having the minimum permissible value selected such as to render the lower limit of the deoxidizing capability of said mixture greater than the deoxidizing capability of any one of the deoxidizing agents used in the lower limit of amount and the maximum permissible value selected such that reduction of the resistance to abrasion is smaller than afforded by the addition of the upper limit of the range of amount of any one of the deoxidizing agents.

From the foregoing description, it has now become clear that the present invention is effective to substantially eliminate formation of blowholes and/or pinholes which may otherwise occur in the chilled structure during the rapid melting process such as the electron bombardment melting process applied to a local surface of cast iron that has been prepared without the addition of any deoxidizing agent. It is therefore clear that, according to the present invention, a solid chilled structure can be obtained on a local surface area of cast iron that has been prepared with the addition of any one of the deoxidizing agents.

What is claimed is:

1. A method of chilling a local surface area of a solid body of cast iron to form thereon a hardened layer of cemented carbide, which comprises 1. making said solid body from cast iron prepared by the addition of a member selected from a group consisting of magnesium, aluminum and calcium, the amount of said material being within the range of 0.002 to 0.03 wt% in the case of magnesium, within the range of 0.05 to 4.0 wt% in the case of aluminum and within the range of 0.1 to 1.0 wt% in the case of calcium, said addition being made to the molten iron during preparation of said cast iron to fix in the form of an oxide, oxygen contained in said molten iron;
2. rapidly melting said local surface area to form a molten pool thereon without generating carbon dioxide due to the presence of said oxide;
3. quickly cooling said molten pool by the chilling effect of the non-molten portion of said solid body thereby permitting said molten pool to be transformed into the hardened layer of cemented carbide; and
4. forming said solid body into a desired shape.

2. The method as claimed in claim 1, wherein said step of rapidly melting said local surface area to form a molten pool on said solid body comprises an electron bombardment process.

3. The method as claimed in claim 1, wherein said cast iron is flaky graphite cast iron.

4. The method as claimed in claim 1, wherein said cast iron is acicular cast iron.

* * * * *